US006758059B2

(12) United States Patent
Kelly et al.

(10) Patent No.: US 6,758,059 B2
(45) Date of Patent: Jul. 6, 2004

(54) DILUTION REFRIGERATOR ASSEMBLY

(75) Inventors: Paul Kelly, Oxford (GB); David Massingham, Oxford (GB); Peter Mile Cetnik, Oxford (GB); Christopher David Wilkinson, Oxford (GB)

(73) Assignee: Oxford Instruments Superconductivity Limited, Oxon (GB)

( * ) Notice: Subject to any disclaimer, the term of this patent is extended or adjusted under 35 U.S.C. 154(b) by 0 days.

(21) Appl. No.: 10/276,068

(22) PCT Filed: Mar. 7, 2002

(86) PCT No.: PCT/GB02/01070

§ 371 (c)(1),
(2), (4) Date: Nov. 12, 2002

(87) PCT Pub. No.: WO02/073100

PCT Pub. Date: Sep. 19, 2002

(65) Prior Publication Data

US 2003/0126886 A1 Jul. 10, 2003

(30) Foreign Application Priority Data

Mar. 9, 2001 (GB) ..... 0105923

(51) Int. Cl.[7] ..... F25J 1/00; F25D 25/00
(52) U.S. Cl. ..... 62/610; 62/62; 62/298
(58) Field of Search ..... 62/610, 259.2, 62/62, 298

(56) References Cited

U.S. PATENT DOCUMENTS

| | | | | | |
|---|---|---|---|---|---|
| 3,894,403 | A | * | 7/1975 | Longsworth | 62/51.1 |
| 5,327,733 | A | * | 7/1994 | Boolchand et al. | 62/51.1 |
| 5,542,256 | A | * | 8/1996 | Batey et al. | 62/610 |
| 5,816,071 | A | * | 10/1998 | Pekola | 62/610 |

FOREIGN PATENT DOCUMENTS

| | | |
|---|---|---|
| DE | 27 44 346 | 4/1979 |
| GB | 2 166424 A | 5/1986 |

OTHER PUBLICATIONS

Reinders, P.H.P., et al., "Novel top–loading 20 mK/15 T cryomagnetic system," Cryogenics, vol. 27, Dec., 1987, pp. 689–692.

Hilton, P.A., et al., "Fully portable, highly flexible dilution refrigerator systems for neutron scattering," Revue Phys. Appl. 19 (1984) 775–777.

* cited by examiner

*Primary Examiner*—William C. Doerrler

(57) ABSTRACT

A dilution refrigerator assembly comprises a first module (1) including a dilution refrigerator (2); and a second module (3) including experimental services for attachment to a sample located in use outside the dilution refrigerator (2). The second module (3) can be attached to and demounted from the first module (1) without compromising the integrity of the dilution refrigerator.

19 Claims, 7 Drawing Sheets

DILUTION REFRIGERATOR ASSEMBLY

This application claims the benefit of PCT International Application Number PCT/GB02/01070 filed Mar. 7, 2002 and United Kingdom Application No. 0105923.7, filed Mar. 9, 2001, in Great Britain, the disclosures of which are incorporated herein by reference.

The invention relates to a dilution refrigerator assembly.

Dilution refrigerators are used for achieving ultra low temperatures for experiments in the millikelvin temperature range. A typical dilution refrigerator includes a still, a mixing chamber, and a heat exchanger connected between the still and mixing chamber whereby coolant flows from the still to the mixing chamber and from the mixing chamber to the still through respective first and second adjacent paths in the heat exchanger. Examples of known dilution refrigerators are described in U.S. Pat. No. 5,189,880, U.S. Pat. No. 5,542,256 and "A Simple Dilution Refrigerator" by J. L. Levine, The Review of Scientific Instruments, Vol. 43, Number 2, February 1972, pages 274–277.

Typically, such a dilution refrigerator uses $^3He/^4He$ and makes use of the fact that when a mixture of these two stable isotopes of helium is cooled below its tri-critical temperature, it separates into two phases. The lighter "concentrated phase" is rich in $^3He$ and the heavier "dilute phase" is rich in $^4He$. Since the enthalpy of the $^3He$ in the two phases is different, it is possible to obtain cooling by "evaporating" the $^3He$ from the concentrated phase into the dilute phase.

In order for dilution refrigerators to be used to investigate samples in high magnetic fields, it has been known to provide an elongate, tubular extension to the mixing chamber which extends into the bore of a magnet. In this case, it is necessary for the $^3He$ return tube also to extend into the mixing chamber extension to promote circulation of $^3He$ around the sample which in turn is held on the end of a holder extending through the refrigerator and the return tube. An example of such a dilution refrigerator which enables a sample to be "top-loaded" is described in "Novel Top-Loading 20 mK/15T Cryomagnetic System" by P. H. P. Reinders et al, Cryogenics 1987 Vol. 27 December, pages 689–692.

Although these known dilution refrigerator assemblies work well, they are relatively inflexible and typically can only be used for one class of experiments at a time. In addition, properties such as the thermodynamic performance cannot be routinely upgraded.

In accordance with the present invention, a dilution refrigerator assembly comprises a first module including a dilution refrigerator; and a second module including experimental services for attachment to a sample located in use outside the dilution refrigerator, wherein the second module can be attached to and demounted from the first module without compromising the integrity of the dilution refrigerator.

We have realised that in contrast to known dilution refrigerator assemblies in which the sample has been located within the mixing chamber, it is possible to cool the sample located outside the mixing chamber (although typically within an evacuated chamber) and this then allows the assembly to be constructed from two modules. In particular, it is possible to provide all cooling services of the dilution refrigerator on or in the first module with experimental services only being provided by the second module. This means the second module need not be reliant on additional cooling power and allows second modules to be interchanged so as to enable many different classes of experiments to be made and also allows second modules or secondary inserts to be upgraded. For example, in the case of wiring for experiments, since the wiring is only attached to the second module, this allows different experiments to be performed by interchanging second modules.

By the phrase "without compromising the integrity of the dilution refrigerator" we mean the structural and functional integrity although of course the dilution refrigerator may have to be removed from a surrounding cryostat to enable the second module to be dismounted.

The second module can be attached to the first module in a variety of ways including, for example, the use of clips, quick release bolts and the like but preferably the first module includes a series of thermal baffles defining aligned holes through which the second module can be inserted. This enables the second module to be easily attached to and demounted from the first module and also avoids the need for additional fixtures. The holes preferably have a diameter greater than 40 mm, typically about 50 mm.

Conveniently, in this case, the second module includes a number of thermal baffles, each aligned with a respective baffle of the first module when the two modules are attached. This provides an impedance to heat flow into the modules.

Preferably, the first and second modules are sealed together with a pair of spaced sealing assemblies. These may comprise an O-ring, for example in the form of a piston seal, and a pair of cooperating flanges held together using a clamp ring.

In some examples, the dilution refrigerator is mounted in a relatively non-detachable manner to the rest of the first module including 1K pot, still pumping line etc. Conveniently, however, the first module-includes a separate dilution unit comprising a still, heat exchanger and mixing chamber which can be demounted as a unit from the rest of the first module. This has the advantage of allowing different dilution units to be attached to the rest of the first module, for example having different performance or to allow upgrades. This is advantageous for example when different types of experiments are to be performed having specific performance requirements of the dilution refrigerator.

In most cases, the sample will be located in use within a magnetic field and typically the sample will be laterally offset from the axis of the second module. However, in the preferred example, the second module includes a sample holder which can be moved laterally with respect to the axis of the second module. Thus, while the second module is attached to the first module, the sample holder can be located in a first position and is thereafter moved laterally to a second position to bring it into alignment with a required part of a magnetic field, for example the centre of the magnetic field. Typically, the sample holder will be mounted via a pivot or slide connection to the rest of the second module.

In most applications the assembly will be located in use within a cryostat but alternatively could be cooled using a dry cooler such as a cryocooler.

An example of a dilution refrigerator assembly according to the invention will now be described with reference to the accompanying drawings, in which:—

The assembly comprises a primary insert 1 to the lower end of which is mounted a dilution unit 2 so as to form a first module; and a secondary insert 3 mounted to the primary insert 1 and defining a second module.

Figure 2:
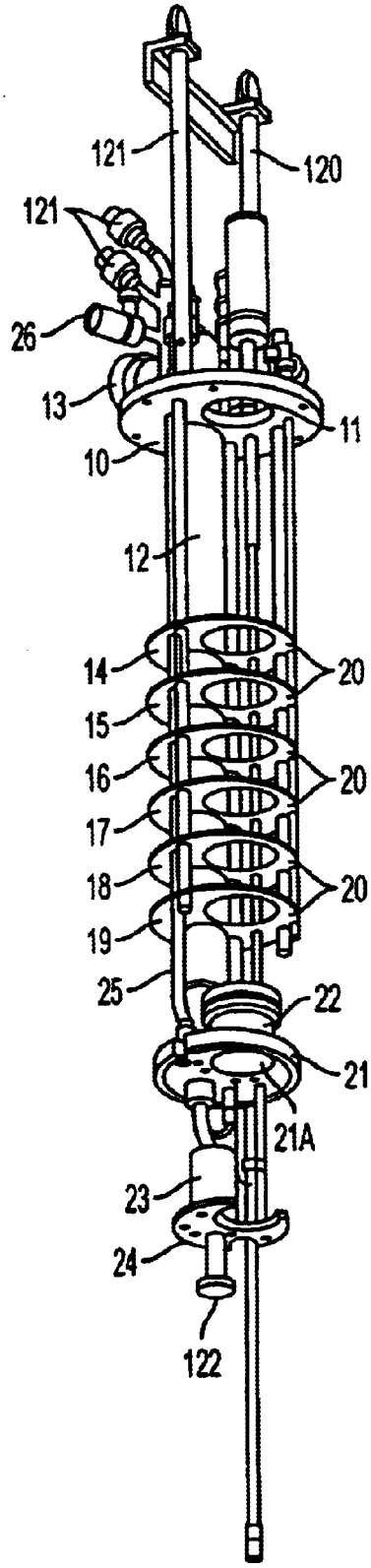
FIG. 2 is a perspective view of the primary insert shown in FIG. 1.

The primary insert 1 is shown in more detail in FIG. 2 and comprises a support flange 10 having a secondary insert port 11 and being connected to a lifting frame and rods 120 by which it can be secured within a cryostat (not shown). A wide diameter still pumping line 12 extends through the flange 10 and communicates with a port 13. Since the still pumping line is capable of handling various flow rates depending upon the chosen dilution unit module, it can be used with numerous dilution units and secondary inserts.

A series of thermal baffles 14–19 are mounted to the still pumping line 12, each baffle 14–19 having an opening 20 with a diameter of about 50 mm, the openings being aligned with each other and with the port 11.

Towards the lower end of the primary insert 1 there is mounted an inner vacuum chamber (IVC) flange 21 having an aperture 21A around which is provided a sleeve 22 in alignment with the apertures 20.

An IVC pumping line 25 extends from the condensing stage 23 through the flange 21 and up through the baffles 14–19 and the flange 10 to terminate in an IVC vacuum pumping port 26.

The still pumping line 12 extends through a 1K condensing stage coil 23 connected to a plate 24 defining a 1K thermal link. The 1K condensing stage 23 is an extended tube coiled inside a housing attached to the 1K thermal link. This extended tube has a steady flow of $^4$He through it bringing its operating temperature down to ~1.5K. Inside this extended tube is a second tube with the circulating $^3$He/$^4$He mixture pre-cooling using the enthalpy of the exhausting $^4$He gas.

The diagnostic wiring for the system, which offers the utility of heaters and thermometry for the operation of the instrument, is also connected from service ports 121 (FIG. 2) at the top of the primary insert to the 1K condensing stage 23.

Figure 4:
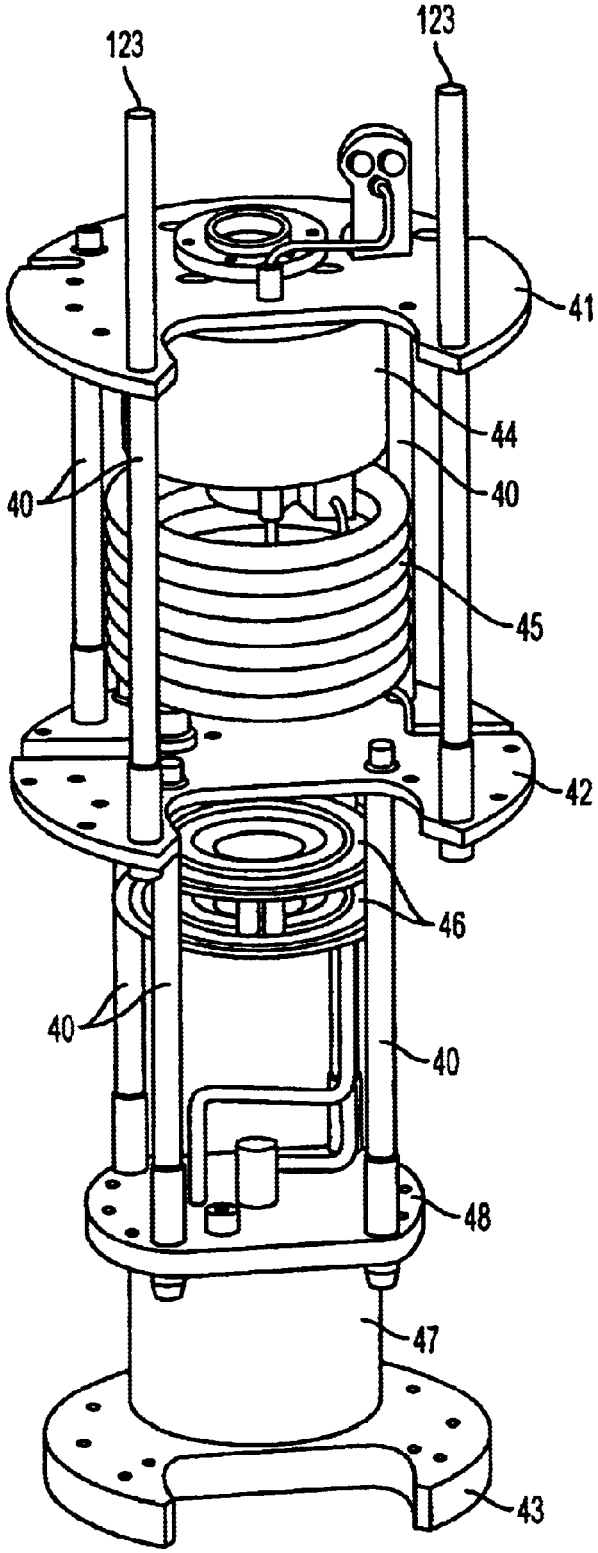
FIG. 4 is a perspective view of the dilution unit shown in FIG. 1 but with some step heat exchangers removed.

FIG. 4 illustrates the dilution unit 2 in more detail. This comprises sets of heat insulating support rods 40 connected to an 700 mK thermal link 41, a 50 mK plate thermal link 42 and a top cap 48 of the mixing chamber 47. The support rods 40 must be strong but also poor thermal conductors as they connect different parts of the system at different temperatures. Mounted on the underside of the 700 mK thermal link 41 is a still 44 which communicates in a conventional way via a coil heat exchanger 45 and further step heat exchangers 46 (only two shown in FIG. 4) with a mixing chamber 47 coupled with a high conductivity mixing chamber bottom plate 43.

A flange 122 beneath the plate 24 providing a 1.5K thermal link is connected to the dilution unit via legs 123 allowing the dilution unit to be detached from the primary insert.

A range of cooling power and base temperature specification instruments can be developed by removing or adding step heat exchangers 46, changing the heat exchanger arrangement inside the mixing chamber 47, or by a combination of these.

The thermodynamic properties of $^3$He and $^4$He are used to create temperatures as low as 7 mK in the mixing chamber 47. The operation of the instrument usually requires the cyclic flow of mainly $^3$He promoted by the use of a room temperature pump. The lowest temperatures are achieved in a stepwise process. Whilst in the circulation mode, the lowest temperatures are achieved in a stepwise process. Prior to reaching the base temperature, $^3$He is pre-cooled to 4.2K at the IVC flange 21 and then to 1.5K in the 1K coil tubing hidden in condensing stage 23. The temperature is further reduced to 700 mK in the still 44 and then to 50 mK using the continuous double walled exchanger 45. The step heat exchangers 46 ensure the cool down from 50 mK to the system base temperature.

Figure 3:
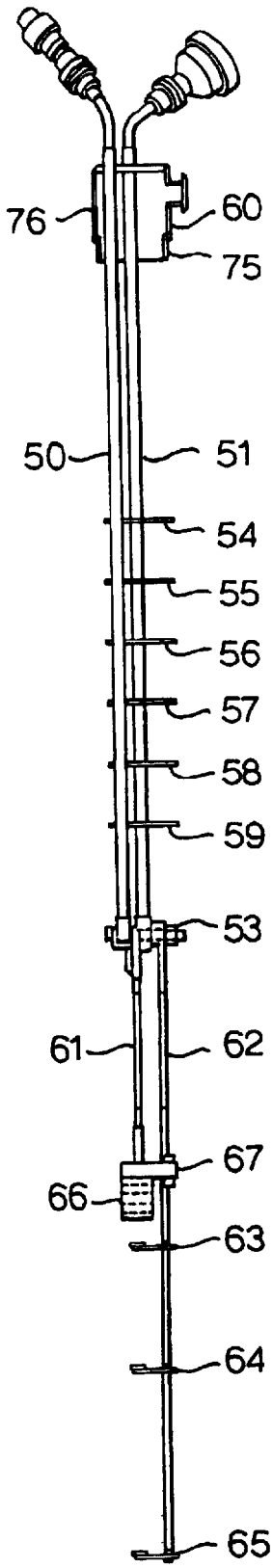
FIG. 3 is a perspective view of the secondary insert shown in FIG. 1 but with the rotator mechanism omitted for clarity.

The secondary insert 3 is shown in more detail in FIG. 3 and is a self contained unit containing all of the experimental services required by the dilution refrigerator user. Typical essential experimental services are—to i) provide a sample platform (providing thermal and mechanical continuity) and ii) provide some wiring to communicate to and from the sample. Typical, optional experimental services include coaxial cables, 24-way constantan looms, wave-guides, and rotator mechanisms.

The secondary insert comprises a pair of vacuum tight tubes 50,51 which extend down to the inner vacuum chamber 52 (FIG. 1) terminating at an IVC indium seal flange 53. The tubes are held in place within the $^4$He bath of the cryostat (not shown) by a series of radiation baffles 54–59 which, as will be described below, align with respective baffles 14–19 of the primary insert 1 respectively. The purpose of tube 50 is to provide a guide and an access to experimental wiring (namely 12 twisted pairs of constantan wires) to the IVC space. The purpose of tube 51 is to bring guide and access to experimental wires (namely high frequency coaxial cabling) to the IVC space.

The tubes 50,51 extend through a piston seal 60 for sealing to the aperture 11 of the flange 10 of the primary insert.

In use, the secondary insert 3 is inserted through the apertures 11,20 and sleeve 22 until the indium seal flange 53 contacts the sleeve 22.

Supporting metallic legs 61,62 depend from the underside of the indium seal flange 53 and extend to a plate 67 linked to plate 24. The 1K thermal link is a crucial thermal dumping stage for the secondary insert and ensures the experimental wiring on the secondary insert is suitably thermally anchored. The tube 62 continues past the dilution unit 2 within the inner vacuum chamber 52 and is thermally linked in use by suitable links 63–65 with the thermal links 41,42 and 43 respectively to ensure the links 63–65 are cooled sufficiently.

Figure 7:
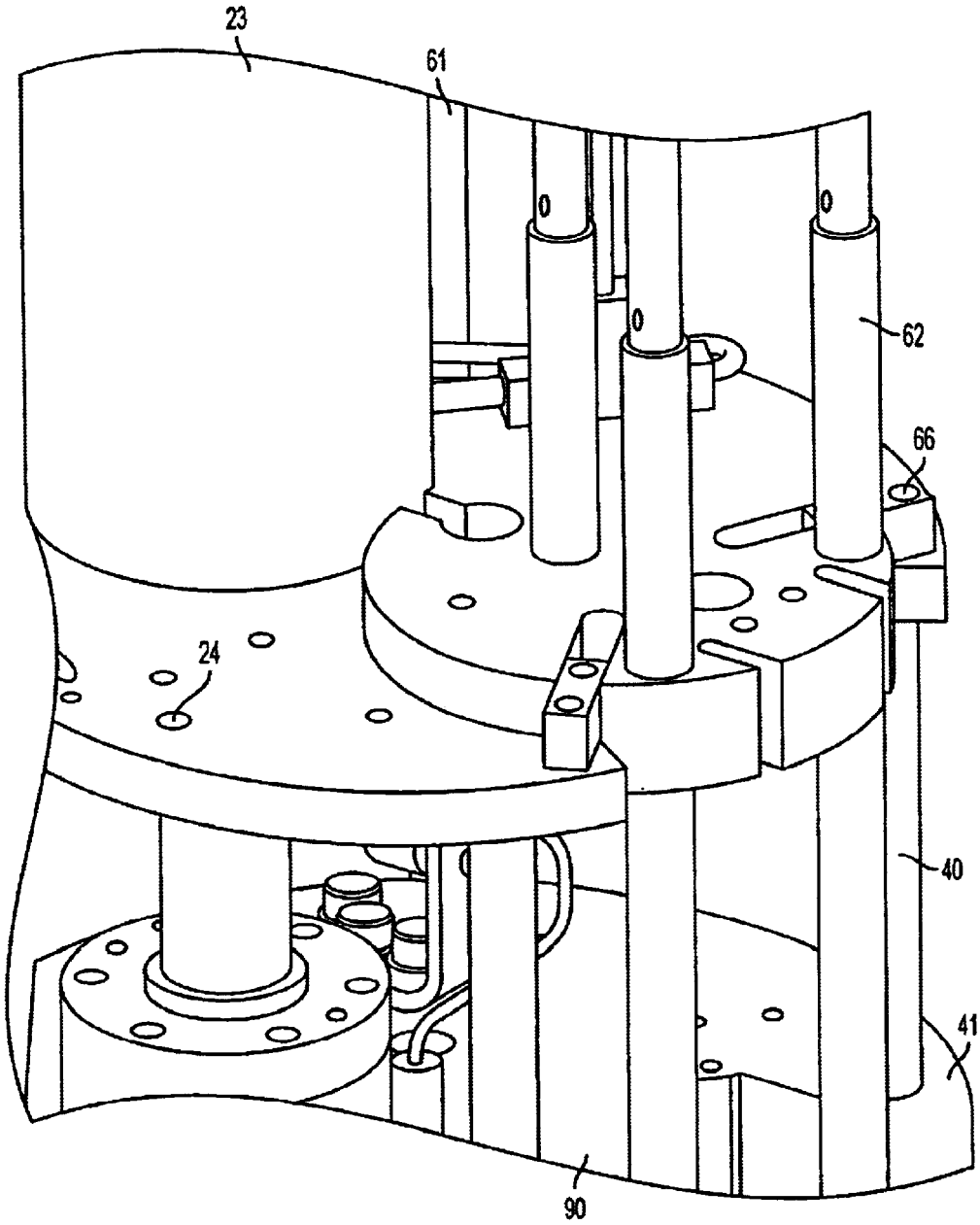

Thermal links 66,90 (FIG. 7) are secured to the condensing stage 23,24 to ensure that the experimental services of the secondary insert are precooled effectively using the cooling power of the condensing stage. The thermal dumping of the secondary insert experimental services is important to the operation of the dilution refrigerator. Cooling power is generated on the primary insert 1 and the dilution unit 2 while the main source of heat in the system is from the wiring on the secondary insert 3. Good thermal contact is ensured by using high thermal conductivity copper thermal links to connect the secondary insert 3 thermal link to the primary insert thermal link or plate 24. As can be seen in FIG. 3, the thermal link 66 is coupled to the leg 62 through which the experimental surfaces wires pass.

Figure 1:
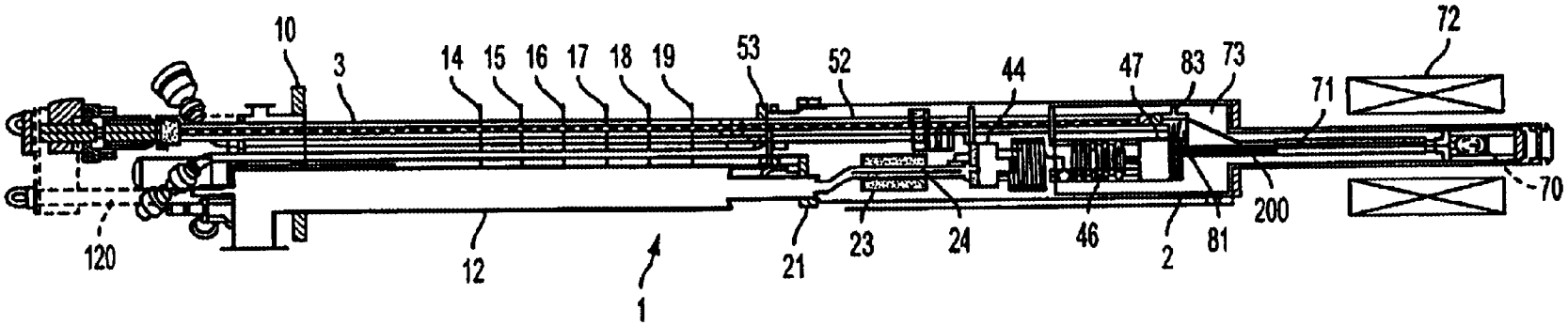
FIG. 1 is a longitudinal, part sectional view of the assembly when fully assembled.

The lowermost thermal link 65 of the secondary insert can carry a sample directly or, as shown in FIG. 1 is connected to a sample 70 via a rotator assembly 200 comprising a sample holder or cold finger 71. The sample could alternatively be connected to the underside of the mixing chamber 47. The sample 70 will be located in a magnetic field generated by a solenoid 72 located within the cryostat.

Figure 6:
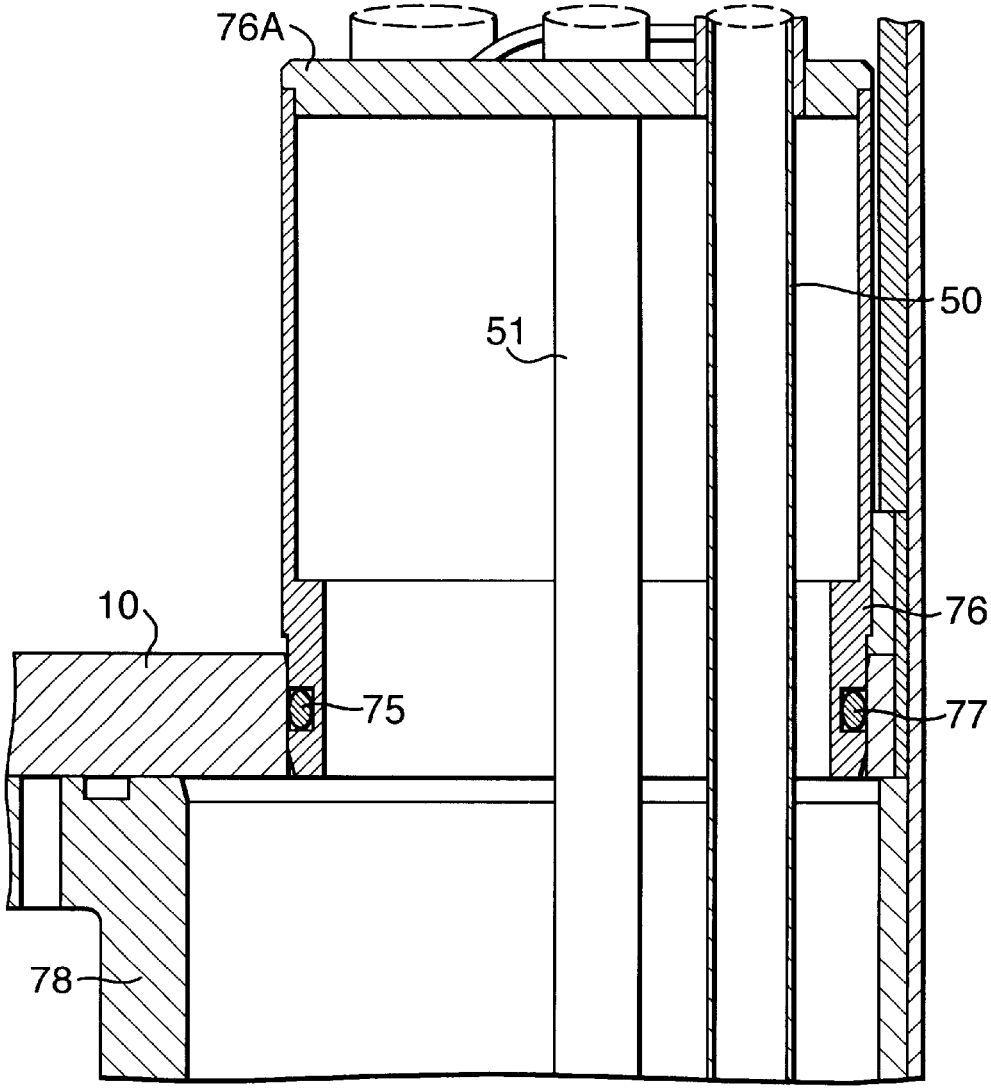
FIG. 6 illustrates the upper seal between the primary and secondary inserts; and, FIG. 7 is a perspective view showing the thermal connection between the primary and secondary inserts.

As mentioned previously, the upper end of the secondary insert 3 is sealed to the flange 10 of the primary insert by a piston seal. This is constituted by an O-ring 77 located in a groove 75 of a cylinder 76 sealed to the tubes 50,51 via a cover plate 76A, the O-ring sealing against the inner surface of the aperture 11 and the flange 10 (FIG. 6). FIG. 6 also shows part of the wall 78 of the surrounding cryostat onto which the flange 10 is sealed.

The simple rubber O-ring seal has a relatively large tolerance which allows the seal to move during the thermal contraction of the two inserts as they cool and also allows the indium seal to be made independent of the top of the secondary insert being precisely positioned.

Figure 5:
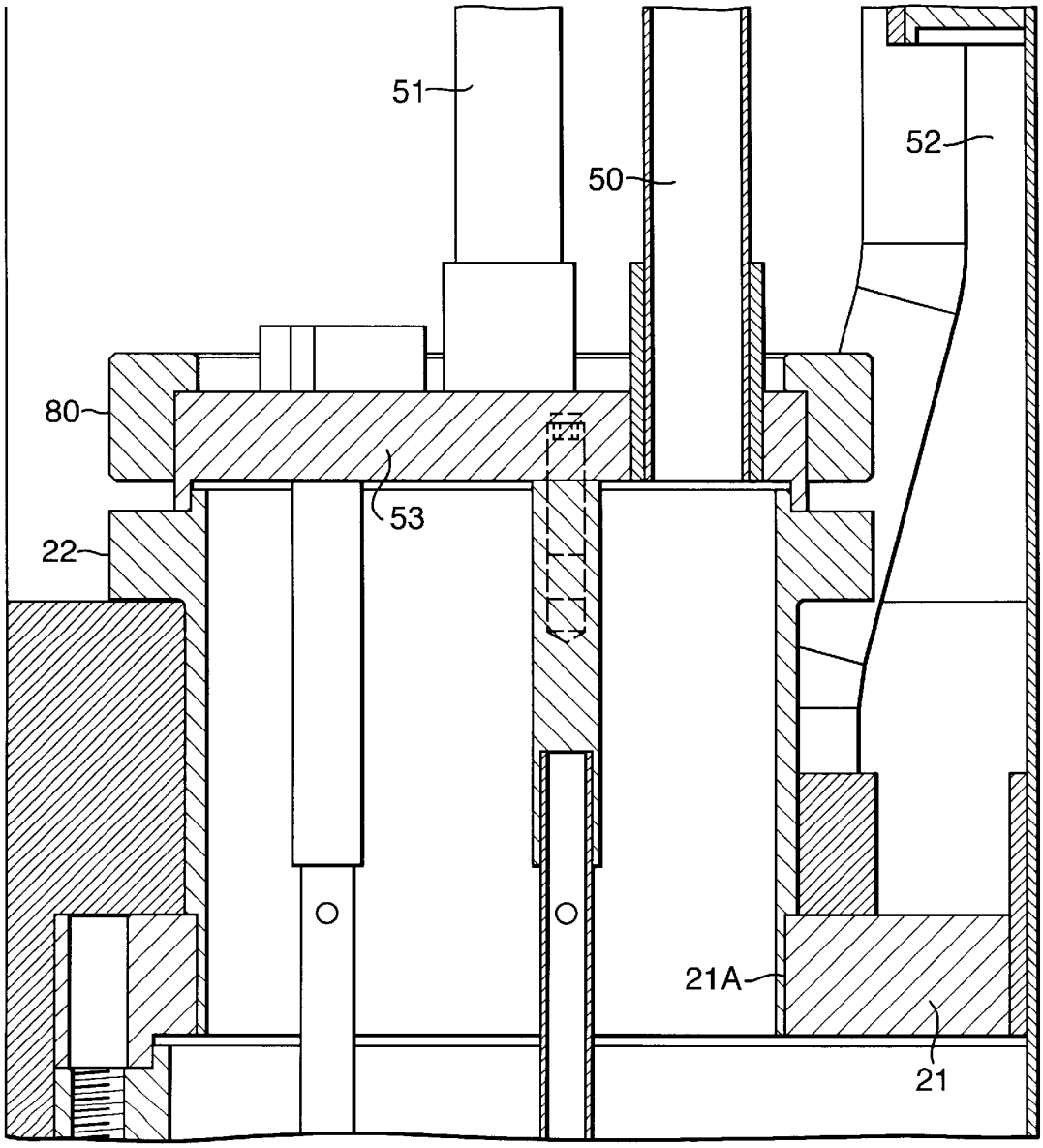
FIG. 5 illustrates the lower seal between the secondary and primary inserts.

The lower seal is formed between the flange 53 of the secondary insert 3 and the sleeve 22 of the primary insert, the two being held together by a split ring clamping flange 80 (FIG. 5). This clamping method allows the secondary insert to utilize the maximum possible diameter of the primary insert port for wiring services without limiting the service entry due to engineering obstacles such as step flanges and bolt rings. Using this arrangement, the line of sight through clearance for the secondary insert experimental services is maximised.

To make the lower seal, the indium flange 53 on the secondary insert is offered up to the indium seal or cylinder 22 on the primary insert with a ring of indium wire between the flanges. The split ring 80 is then clamped around the top of the secondary insert indium flange 53 and bolted down onto a mating bolt ring on the primary insert indium flange clamping the flanges together forming a leak tight seal. The bolt ring and bolts are omitted from FIG. 5.

If the cold finger 71 is mounted fixedly, to the secondary insert then in order to enable that insert to be slid through the apertures 20 the cold finger must be in alignment with the rest of the secondary insert. This would mean that at the lower end it would be offset laterally relative to the coil 72 which in some cases may be undesirable. In the arrangement shown in FIG. 1, therefore, the cold finger 71 is connected to a thermally conducting plate 83 which is pivoted to the underside of the thermal link 65 at 81. The plate 83 can be pivoted to bring the cold finger 71 into alignment with the rest of the secondary insert allowing the secondary insert to be slid through the apertures 20 following which the plate 83 is pivoted to the position shown in FIG. 1 where the sample will be correctly positioned laterally with respect to the magnetic field.

Once fully assembled into a rigid structure, as shown in FIG. 1, the assembly is located in a helium bath of a surrounding cryostat (not shown), the sample being located in the bore of a magnet 72. As can be seen in FIG. 1, a thermal radiation shield 73 surrounds the sample 70 to isolate the sample form 4.2K radiation coming from the IVC 52.

What is claimed is:

1. A dilution refrigerator assembly comprising a first module including a dilution refrigerator; and a second module including experimental services for attachment to a sample located in use outside the dilution refrigerator, wherein the second module can be attached to and demounted from the first module without compromising the integrity of the dilution refrigerator.

2. An assembly according to claim 1, wherein the first module includes a series of thermal baffles defining aligned holes through which the second module can be inserted.

3. An assembly according to claim 2, wherein the second module includes a number of thermal baffles, each aligned with a respective baffle of the first module when the two modules are attached.

4. An assembly according to claim 1, wherein the first and second modules are sealed together with a pair of spaced sealing assemblies.

5. An assembly according to claim 4, wherein the sealing assemblies comprise a piston seal and a pair of cooperating flanges held together by a clamp ring respectively.

6. An assembly according to claim 1, wherein the first module includes a separate dilution unit comprising a still, heat exchanger and mixing chamber which can be demounted as a unit from the rest of the first module.

7. An assembly according to claim 1, wherein the second module includes a sample holder which can be moved laterally with respect to the axis of the second module.

8. An assembly according to claim 7, wherein the sample holder is mounted via a pivot or slide connection to the rest of the second module.

9. An assembly according to claim 2, wherein the first and second modules are sealed together with a pair of spaced sealing assemblies.

10. An assembly according to claim 3, wherein the first and second modules are sealed together with a pair of spaced sealing assemblies.

11. An assembly according to claim 2, wherein the first module includes a separate dilution unit comprising a still, heat exchanger and mixing chamber which can be demounted as a unit from the rest of the first module.

12. An assembly according to claim 3, wherein the first module includes a separate dilution unit comprising a still, heat exchanger and mixing chamber which can be demounted as a unit from the rest of the first module.

13. An assembly according to claim 4, wherein the first module includes a separate dilution unit comprising a still, heat exchanger and mixing chamber which can be demounted as a unit from the rest of the first module.

14. An assembly according to claim 5, wherein the first module includes a separate dilution unit comprising a still, heat exchanger and mixing chamber which can be demounted as a unit from the rest of the first module.

15. An assembly according to claim 2, wherein the second module includes a sample holder which can be moved laterally with respect to the axis of the second module.

16. An assembly according to claim 3, wherein the second module includes a sample holder which can be moved laterally with respect to the axis of the second module.

17. An assembly according to claim 4, wherein the second module includes a sample holder which can be moved laterally with respect to the axis of the second module.

18. An assembly according to claim 5, wherein the second module includes a sample holder which can be moved laterally with respect to the axis of the second module.

19. An assembly according to claim 6, wherein the second module includes a sample holder which can be moved laterally with respect to the axis of the second module.

* * * * *